US007865990B2

(12) United States Patent
Jeong

(10) Patent No.: US 7,865,990 B2
(45) Date of Patent: Jan. 11, 2011

(54) WASHING MACHINE AND OPERATING METHOD THEREOF

(75) Inventor: Hoi Jin Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 267 days.

(21) Appl. No.: 11/760,110

(22) Filed: Jun. 8, 2007

(65) Prior Publication Data

US 2007/0283510 A1 Dec. 13, 2007

(30) Foreign Application Priority Data

Jun. 9, 2006 (KR) ..... 10-2006-0052133

(51) Int. Cl.
*D06F 35/00* (2006.01)

(52) U.S. Cl. ..... 8/158

(58) Field of Classification Search ..... 8/158
See application file for complete search history.

(56) References Cited

U.S. PATENT DOCUMENTS 6,760,942 B2 * 7/2004 Lee et al. ..... 8/159
2005/0205549 A1 * 9/2005 Crawford et al. ..... 219/494
2006/0101587 A1 * 5/2006 Hong ..... 8/149.1
2006/0231551 A1 * 10/2006 Ruther et al. ..... 219/707

FOREIGN PATENT DOCUMENTS

DE 697 09 606 5/2004
DE 698 13 489 8/2004

OTHER PUBLICATIONS

German Office Action dated May 21, 2010 and English translation.

* cited by examiner

*Primary Examiner*—Michael Cleveland
*Assistant Examiner*—Samuel A Waldbaum
(74) *Attorney, Agent, or Firm*—KED & Associates, LLP

(57) ABSTRACT

A washing machine and an operating method thereof are provided. The washing machine detects an input voltage, and increases or reduces a wash time according to the input voltage. Thus, the washing machine can precisely calculate a wash time by reflecting a heating time that varies according to the input voltage. In addition, the washing machine can improve user convenience by enabling a user to easily determine the progress of a washing operation and the end time of the washing operation.

18 Claims, 6 Drawing Sheets

WASHING MACHINE AND OPERATING METHOD THEREOF

This application claims priority from Korean Patent Application No. 10-2006-0052133 filed on Jun. 9, 2006 in the Korean Intellectual Property Office, the disclosure of which is incorporated herein by reference in its entirety.

BACKGROUND OF THE INVENTION

1. Field of the Invention

The present invention relates to a washing machine and an operating method thereof, and more particularly, to a washing machine which can alter an estimated wash time according to an input voltage applied to the washing machine, and an operating method of the washing machine.

2. Description of the Related Art

In general, washing machines are devices for cleaning laundry by supplying wash water so that the laundry can be soaked, dissolving a detergent into the wash water, and removing dust and dirt from the laundry. More specifically, washing machines rotate a drum including laundry so that mechanical friction or vibration between wash water and the laundry can be caused, and that dust and dirt can be easily removed from the laundry.

Washing machines may perform washing, rinsing, and dewatering operations according to various settings. Washing machines may include a heater for adjusting the temperature of wash water. In this case, dust and dirt can be effectively removed from laundry by heating wash water, using the heater, to a predetermined temperature that is set in advance.

Conventionally, washing machines calculate an estimated wash time and display the estimated wash time at an initial stage of the setting of a number of wash parameters. However, in the case of a washing operation including a heating operation for heating wash water using a heater, an wash time estimated for the washing operation may be considerably discrepant from the amount of time actually taken to perform the washing operation because the amount of time required to perform the heating operation varies according to an input voltage applied to a washing machine. As a result, washing machines may provide a user with incorrect wash time information.

In addition, washing machines may not be able to properly display remaining wash time information, which supposedly decreases gradually as washing proceeds, especially before or after a heating operation, thereby often confusing users about the exact end time of a washing operation and considerably decreasing user convenience.

SUMMARY OF THE INVENTION

The present invention provides a washing machine which can alter an estimated wash time currently being displayed, according to an input voltage applied to the washing machine and can thus provide a precisely estimated wash time that properly reflects the progress of a washing operation, and an operating method of the washing machine.

According to an aspect of the present invention, there is provided an operating method of a washing machine, the operating method including receiving settings data regarding a washing course and other wash parameters; detecting an input voltage; and calculating a wash time based on the settings data and the input voltage and outputting the calculated wash time.

According to another aspect of the present invention, there is provided a washing machine including a heater which heats wash water contained in a drum; a voltage detection unit which detects an input voltage applied to the washing machine; a wash time calculation unit which calculates a wash time based on the input voltage and settings data regarding a number of wash parameters including a washing course; and a control unit which performs a washing operation according to the settings data and controls the calculated wash time to be output.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown.

Figure 1:
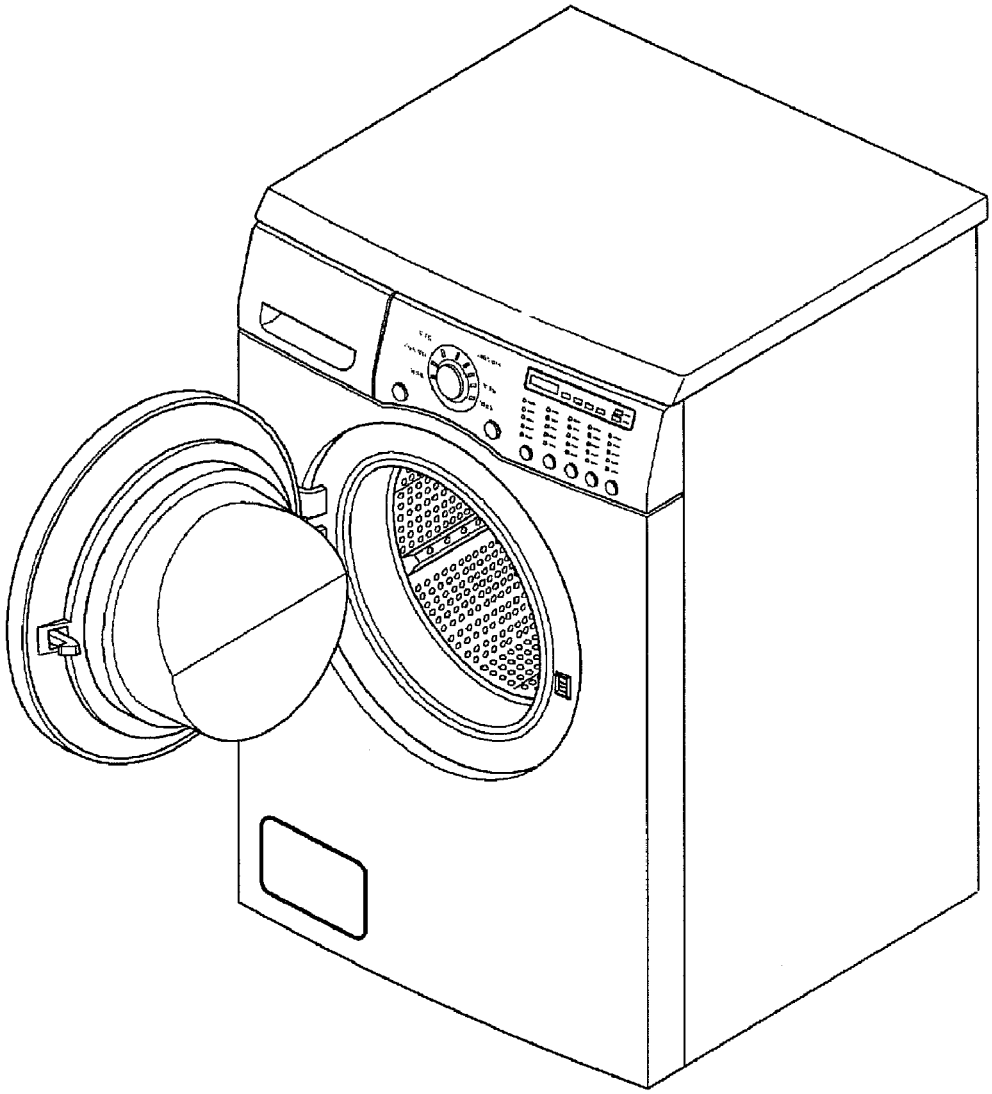
FIG. 1 is a perspective view of a washing machine according to an embodiment of the present invention.
Figure 2:
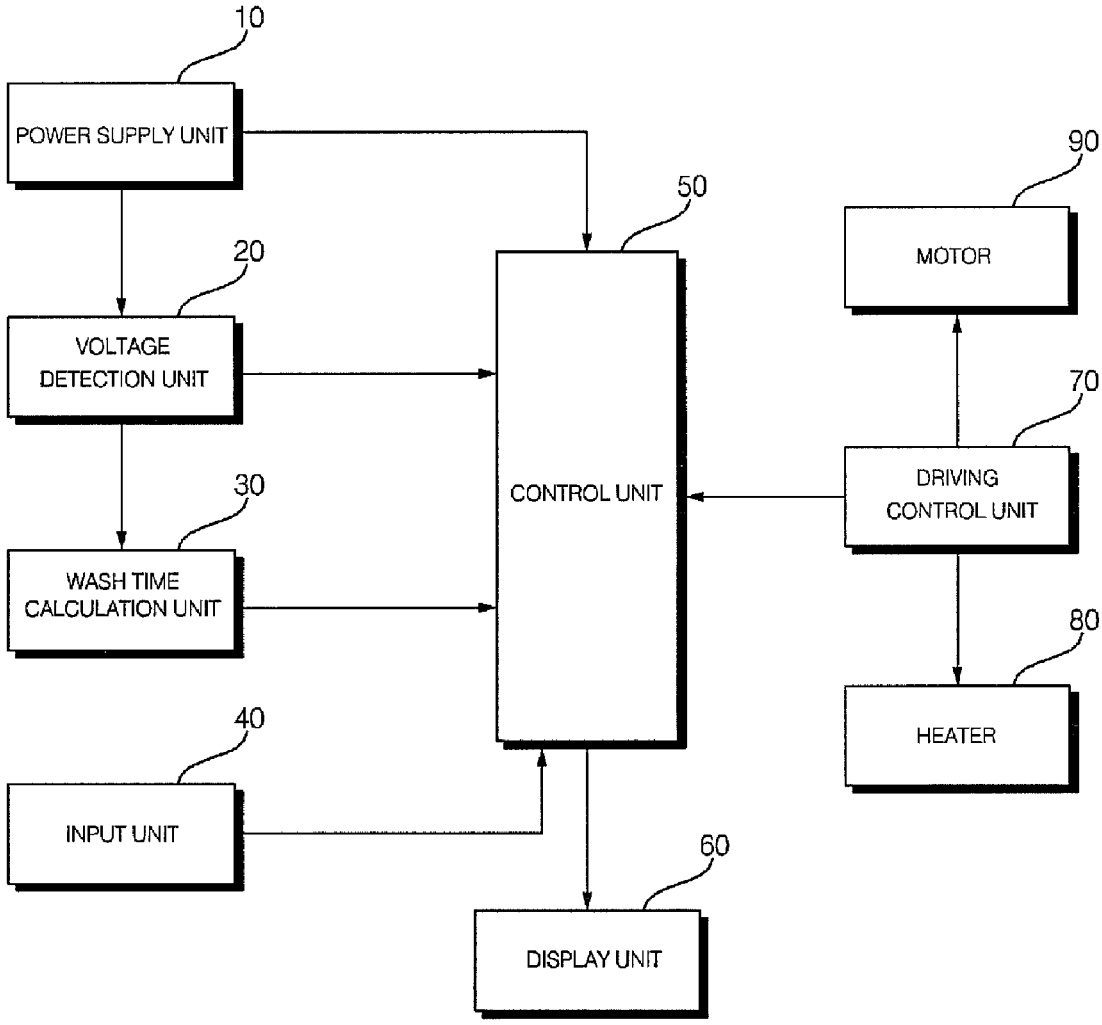
FIG. 2 is a block diagram of the washing machine illustrated in FIG. 1.

FIG. 1 is a perspective view of a washing machine according to an embodiment of the present invention, and FIG. 2 is a block diagram of the washing machine illustrated in FIG. 1. Referring to FIGS. 1 and 2, the washing machine includes a motor 90 which rotates a drum, a heater 80 which heats wash water, a driving control unit 70 which controls the driving of the motor 90 and the heater 80, a voltage detection unit 20 which detects a voltage input to the washing machine, a wash time calculation unit 30 which calculates a wash time, an input unit 40 which receives settings data regarding a number of wash parameters such as a washing course, and a display unit 60 which displays the calculated wash time provided by the wash time calculation unit 30.

The washing machine also includes a control unit 50. The control unit 50 applies a control command to the driving control unit 70 so that a washing operation can be performed according to the settings data received by the input unit 40. The control unit 50 updates a wash time currently being displayed by the display unit 60 with the calculated wash time provided by the wash time calculation unit 30 so that the calculated wash time provided by the wash time calculation unit 30 can be displayed by the display unit 60.

The washing machine also includes a power supply unit 10 which rectifies and smoothes power and a laundry amount detection unit (not shown).

The voltage detection unit 20 may detect an input voltage applied to the washing machine by the power supply unit 10, but the present invention is not restricted to this. In other words, the voltage detection unit 20 may detect a current supplied to the washing machine by the power supply unit 10.

The voltage detection unit 20 may detect the input voltage at least one time at regular intervals of time.

The input unit 40 may include a plurality of buttons and receive various settings data regarding a washing course, a washing temperature, and a wash water level.

The display unit 60 outputs the settings data received by the input unit 40, and also outputs information such as the progress of a washing operation and a remaining wash time. In addition, the display unit 60 outputs the calculated wash time provided by the wash time calculation unit 30, and also outputs various messages during washing.

The driving control unit 70 supplies a current to or applies a voltage to the motor 90 and the heater 80 in response to the control command applied thereto by the control unit 50. Then, the motor 90 and the heater 80 are driven, thereby performing a washing operation.

The heater 80 may include a drying heater and a steam heater. The heater 80 may be driven when a boiling wash course, which is a type of washing course is performed.

The wash time calculation unit 30 calculates a wash time based on an input voltage value provided by the voltage detection unit 20 and the settings data received by the input unit 40. If no additional heating operation is required, the wash time calculation unit 30 may not count heating time during the calculation of a wash time. Instead, the wash time calculation unit 30 may calculate a base wash time only in consideration of the settings data received by the input unit 40.

The wash time calculation unit 30 may calculate an average input voltage value by averaging a plurality of input voltage values provided by the voltage detection unit 20.

More specifically, the wash time calculation unit 30 may calculate the base wash time based on the settings data received by the input unit 40, and calculate the heating time based on the average input voltage value. Thereafter, the wash time calculation unit 30 may calculate a wash time by adding up the base wash time and the heating time.

The wash time calculation unit 30 calculates the heating time based on the input voltage and an elapsed wash time.

More specifically, the wash time calculation unit 30 calculates a maximum heating time based on settings data regarding a number of wash parameters including a washing temperature, the amount of laundry, and a wash water level and the type and the capacity of the heater 80. The wash time calculation unit 30 calculates the heating time by multiplying a heating time coefficient by the average input voltage value and subtracting the result of the multiplication from the maximum heating time. The heating time coefficient varies according to the capacity of the heater 80 and the input voltage.

In short, the wash time calculation unit 30 may calculate the heating time, as indicated by Equation (1) below:

$$T_h = T_h\max - Gh \times V_\text{in}$$

where T_h is the heating time, T_hmax is the maximum heating time, Gh indicates the heating time coefficient, and V_in indicates the average input voltage value. The heating time coefficient Gh indicates the degree to which the heating time T_h fluctuates according to the capacity of the heater 80 and the input voltage, i.e., the ratio of a variation in the heating time T_h to a variation in the input voltage.

After a heating operation, the wash time calculation unit 30 calculates an error between the heating time T_h and an actual heating time, which is the time actually taken to perform the heating operation, and compensates for the error, thereby updating an initially calculated wash time.

The control unit 50 completes a wash parameter setting operation using the settings data provided by the input unit 40, and generates and then applies a control command so that a washing operation can be performed according to the settings data provided by the input unit 40.

In other words, the control unit 50 generates a control signal for driving the motor 90 and the heater 80 according to the settings data provided by the input unit 40, and applies the control signal to the driving control unit 70. Then, the driving control unit 70 controls the motor 90 and the heater 80 so that a washing/rinsing/dewatering operation can be performed, and that dust and dirt can be removed from laundry.

The control unit 50 controls the display unit 60 to display the settings data provided by the input unit 40. When a change is made to the settings data provided by the input unit 40, the control unit 50 controls the display unit 60 to readily reflect it into settings data currently being displayed by the display unit 60.

Once a washing operation begins, the control unit 50 may count an elapsed time after the beginning of the washing operation by using a timer (not shown), and provide elapsed wash time information to the wash time calculation unit 30. The control unit 50 controls the display unit 60 to display a calculated wash time provided by the wash time calculation unit 30. The control unit 50 may also control the display unit 60 to display a wash time corrected and updated by the wash time calculation unit 30.

The relationship between an input voltage applied to a washing machine and heating time will hereinafter be described in detail with reference to FIG. 3.

Figure 3:
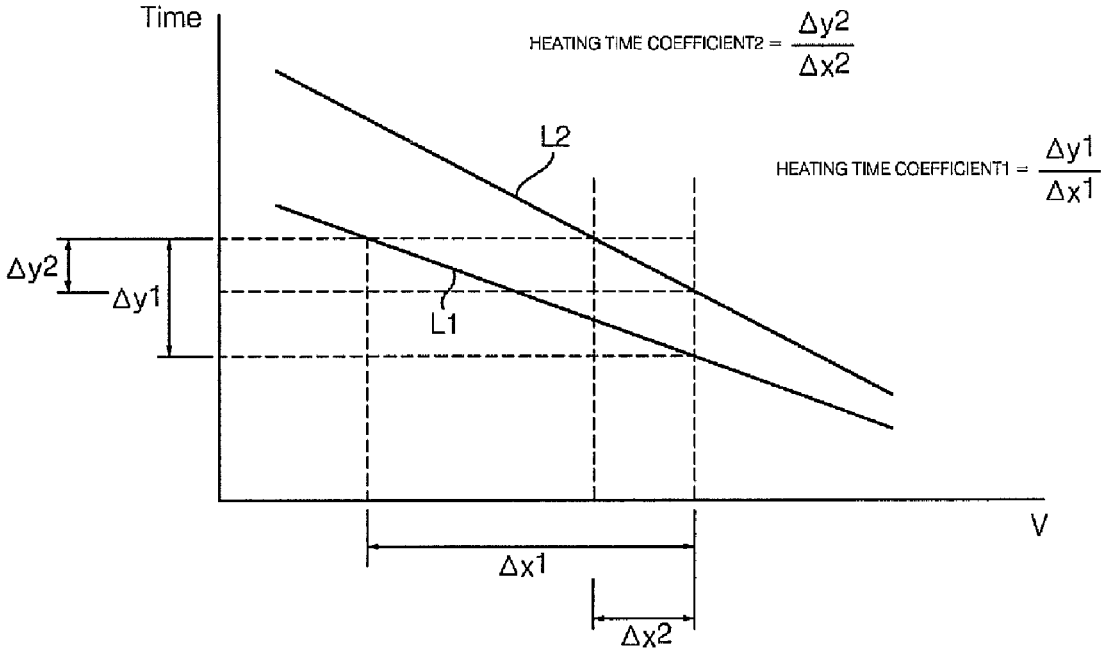
FIG. 3 explains the relationship between an input voltage applied to a washing machine and a wash time, according to an embodiment of the present invention.

FIG. 3 explains the relationship between an input voltage applied to a washing machine and a wash time. Referring to FIG. 3, as the input voltage increases, heating time gradually decreases. The heating time may vary according to the amount of laundry, the capacity of a heater, and a wash temperature and a wash water level that are set in advance.

More specifically, FIG. 3 illustrates the variation of heating time with respect to an input voltage applied to a washing machine for different amounts of laundry when the capacity of a heater, a wash temperature, and a wash water level are uniformly maintained. Referring to FIG. 3, heating time coefficient 1 corresponds to linear graph L1 and is the ratio of a variation $\Delta y1$ in heating time to a variation $\Delta x1$ in an input voltage applied to a washing machine, whereas heating time coefficient 1 corresponds to linear graph L2 and is the ratio of a variation $\Delta y2$ in the heating time to a variation $\Delta x2$ in the input voltage.

A plurality of heating time coefficients may be obtained by detecting a variation in heating time with respect to a variation in an input voltage applied to a washing machine while varying such operating conditions of the washing machine as the amount of laundry, the capacity of a heater, a wash temperature, and a wash water level. Then, the plurality of heating time coefficients may be stored in a database. In this case, the wash time calculation unit 30 may read out a heating time coefficient corresponding to current wash parameter settings from the database, and calculate heating time based on the read-out heating time coefficient.

Alternatively, the wash time calculation unit 30 may calculate heating time by calculating a maximum heating time based on an input voltage and current wash parameter settings, adding up the heating time coefficient corresponding to the current wash parameter settings and the input voltage, and subtracting the result of the addition from the maximum heating time.

When a heating operation ends, the wash time calculation unit 30 compares calculated heating time with an actual heating time, and calculates an error between the calculated heating time and the actual heating time. Thereafter, the wash time calculation unit 30 corrects an initially calculated wash time by adding the calculated error to or subtracting the calculated error from the initially calculated wash time.

An operation of a washing machine according to an embodiment of the present invention will hereinafter be described in detail with reference to FIG. 4.

Figure 4:
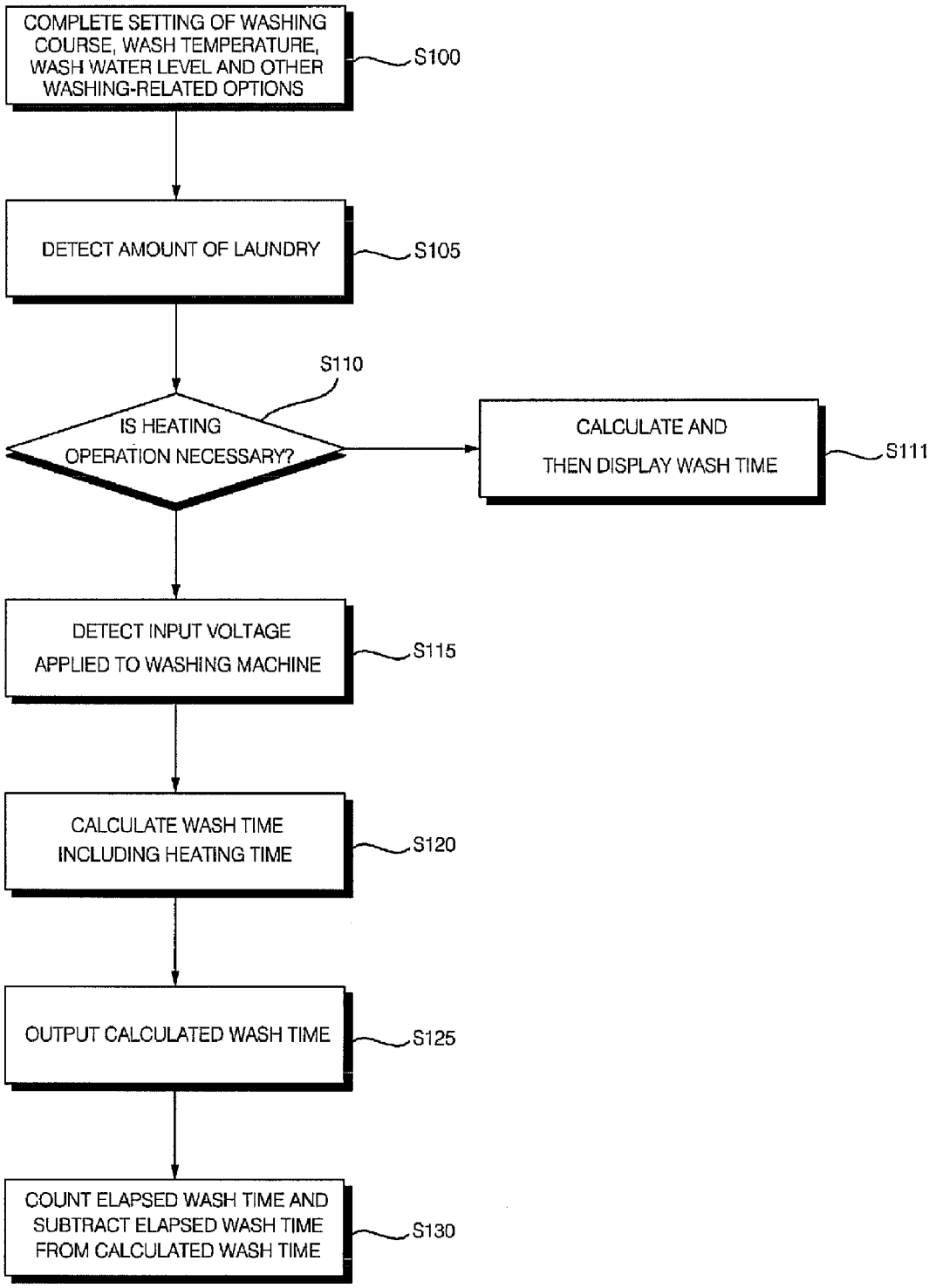
FIG. 4 is a flowchart illustrating an operating method of a washing machine according to an embodiment of the present invention.

FIG. 4 is a flowchart of an operating method of a washing machine according to an embodiment of the present invention. Referring to FIG. 4, in operation S100, a number of wash parameters such as a washing course, a wash temperature, and a wash water level are set using either a user setting method or a default setting method, thereby obtaining settings data.

In operation S105, the amount of laundry is detected. According to an embodiment of the present invention, the wash water level may be automatically set according to the result of the detection performed in operation S105.

In operation S110, it is determined whether a heating operation is necessary based on the settings data (particularly, the washing course and the wash temperature).

If the washing course includes a number of courses such as heating, boiling, and drying which involve the use of a heater, it may be determined in operation S110 that a heating operation is necessary. In addition, if the wash temperature is higher than a predetermined temperature, it may be determined in operation S110 that a heating operation is necessary for heating wash water to the wash temperature.

More specifically, in operation S115, if it is determined in operation S110 that a heating operation is necessary, an input voltage applied to a washing machine is detected. The detection of the input voltage may be detected one or more times at regular intervals of time.

In operation S120, a wash time is calculated by calculating a base wash time based on the settings data regarding the washing course and the wash temperature, calculating a heating time based on the settings data, the capacity of a heater, and the input voltage, and adding up the base wash time and the heating time.

If the input voltage is a high voltage, the heating time may decrease. On the other hand, if the input voltage is a low voltage, the heating time may increase. In other words, the heating time is inversely proportional to the input voltage.

In operation S111, if it is determined in operation S110 that no heating operation is necessary, a base wash time is calculated simply based on the settings data (particularly, the washing course and the wash temperature) without the need to calculate a heating time.

In operation S125, the calculated wash time obtained in operation S120 is output. The calculated wash time obtained in operation S120 is a total amount of time required to perform a washing operation according to the settings data.

In operation S130, once a washing operation begins, an elapsed time after the beginning of the washing operation is counted, a remaining wash time is calculated by subtracting the elapsed wash time from the calculated wash time, and the remaining wash time is output.

The calculation of a wash time by a washing machine will hereinafter be described in further detail with reference to FIG. 5.

Figure 5:
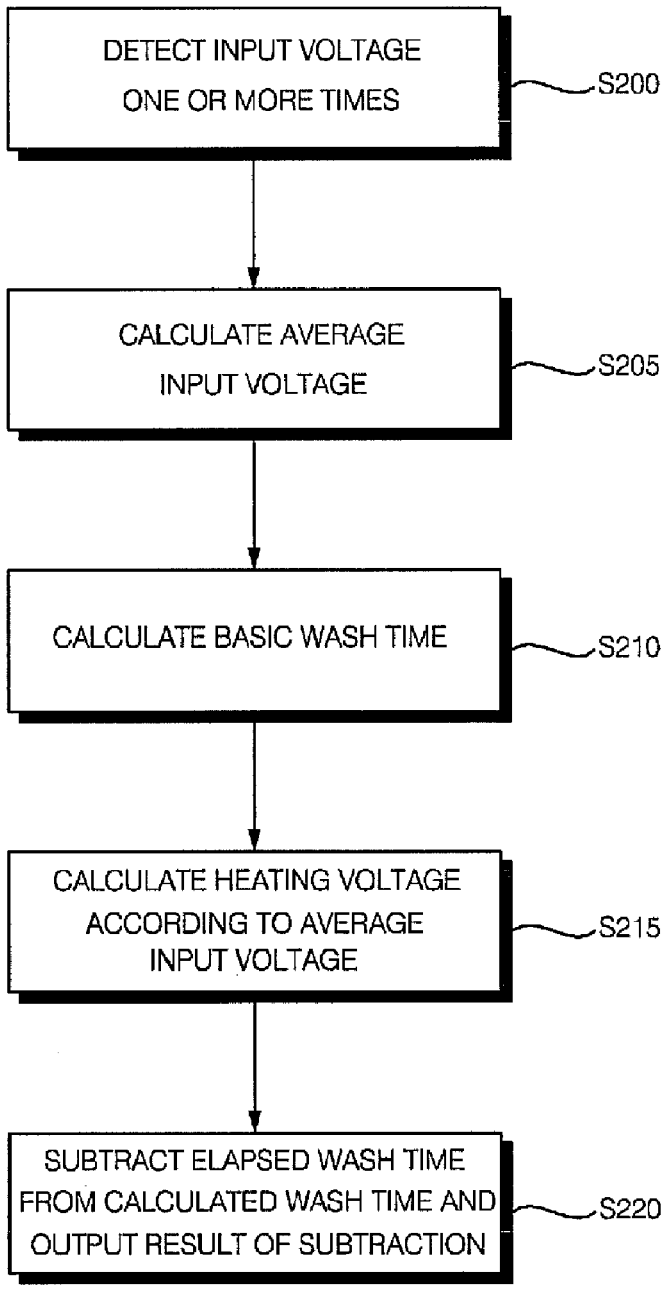
FIG. 5 is a flowchart illustrating the calculation of a wash time by a washing machine, according to an embodiment of the present invention according to an embodiment of the present invention.

FIG. 5 is a flowchart illustrating the calculation of a wash time by a washing machine, according to an embodiment of the present invention. Referring to FIG. 5, in operation S200, an input voltage applied to a washing machine is detected more than one time, thereby obtaining a number of input voltage values. In operation S205, the input voltage values are averaged, thereby obtaining an average input voltage.

In operation S210, a base wash time is calculated based on a detected laundry amount and settings data regarding a washing course, a wash temperature, and a wash water level. The base wash time increases in proportion to the detected laundry amount, the wash temperature, and the wash water level. If no heating operation is necessary, a washing operation may be performed according to the base wash time without the need to calculate a heating time.

In operation S215, if a heating operation is necessary, a heating time is calculated based on the average input voltage.

More specifically, in operation S215, a maximum heating time is calculated based on the average input voltage, the settings data, the detected laundry amount, and the capacity of a heater. Thereafter, a heating time is calculated by multiplying the average input voltage by a heating time coefficient and subtracting the result of the multiplication from the maximum heating time.

In operation S220, a wash time is calculated by adding up the base wash time and the heating time, and the wash time is output as a total wash time. Once a washing operation proceeds, a remaining wash time that gradually decreases as the washing operation proceeds may be output.

The correction of a wash time during a washing operation will hereinafter be described in detail with reference to FIG. 6.

Figure 6:
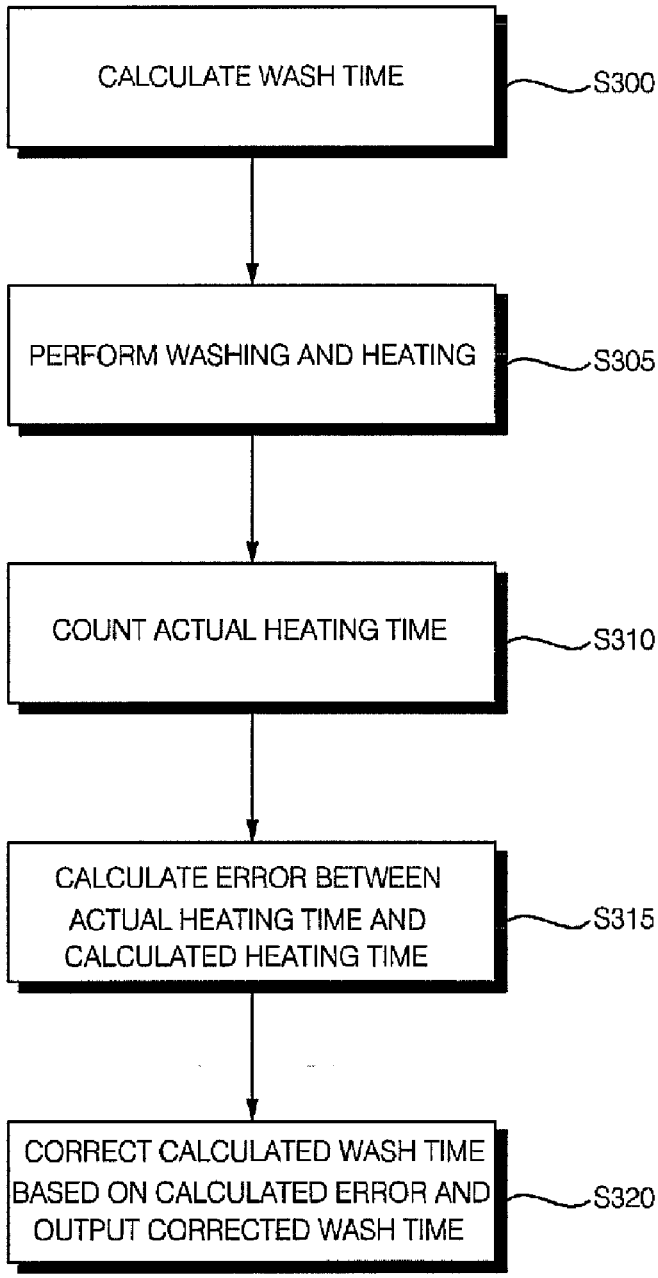
FIG. 6 is a flowchart illustrating the correction of a wash time by a washing machine, according to an embodiment of the present invention.

FIG. 6 is a flowchart illustrating the correction of a wash time by a washing machine, according to an embodiment of the present invention. Referring to FIG. 6, in operation S305, once a wash time is calculated and the calculated wash time is output in operation S300, a washing operation including a heating operation is performed according to current wash parameter settings in response to a predetermined command.

In operation S310, a remaining wash time is calculated by counting an elapsed time after the beginning of the washing operation and subtracting the elapsed wash time from the calculated wash time, and the remaining wash time is displayed. The remaining wash time gradually decreases as the washing operation proceeds.

In operation S310, an actual heating time, which is the time actually taken to perform the heating operation, is calculated.

In operation S315, the actual heating time is compared with an initially calculated heating time, and an error, if any, between the actual heating time and the initially calculated heating time is calculated.

In operation S320, the calculated wash time is corrected by adding the calculated error to or subtracting the calculating error from the initially calculated heating time, and the corrected wash time is output.

As described above, according to the present invention, a wash time can be varied according to an input voltage applied to a washing machine. Thus, it is possible to precisely calculate a wash time by reflecting a heating time that varies according to the input voltage. In addition, it is possible to address problems such as failures to properly display a wash time. Moreover, it is possible to considerably enhance the reliability of a washing machine and maximize user convenience by enabling a user to easily determine the progress of a washing operation and the end time of the washing operation.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An operating method of a washing machine, the operating method comprising:

receiving setting data regarding a washing course and other wash parameters;

calculating a base wash time based on the setting data;

determining whether a heating operation for heating wash water is necessary;

detecting an input voltage when the heating operation is determined to be necessary;

calculating a heating time based on the input voltage; and outputting the calculated wash time by adding the calculated base wash time and the calculated heating time; and performing a washing process based on outputted calculated washing time.

2. The operating method of claim 1, wherein the detection comprises:

obtaining a number of input voltage values by detecting the input voltage more than once; and averaging the input voltage values.

3. The operating method of claim 1, wherein the calculation comprises increasing or reducing heating time according to the input voltage in value.

4. The operating method of claim 3, further comprising:

when a heating operation ends, calculating an error between the heating time and an actual heating time which is the time actually taken to perform the heating operation; and increasing or reducing the calculated wash time by as much as the calculated error.

5. The operating method of claim 1, further comprising calculating a maximum heating time according to at least one of a wash temperature, an amount of laundry, a wash water level, and a capacity of a heater.

6. The operating method of claim 5, further comprising:

multiplying a heating time coefficient by the input voltage; and calculating the heat time by subtracting the result of the multiplication from the maximum heating time.

7. The operating method of claim 6, wherein the heating time coefficient is a ratio of a variation in the heating time to a variation in the input voltage.

8. The operating method of claim 7, further comprising:

obtaining a number of heating time coefficients by varying at least one of the wash temperature, the amount of laundry, the wash water level, and the heater capacity; and storing the heating time coefficients in the washing machine.

9. The operating method of claim 8, wherein the calculation further comprises:

selecting one of the heating time coefficients stored in the washing machine; and calculating the heating time using the selected heating time coefficient.

10. An operating method of a washing machine, the operating method comprising:

receiving setting data regarding a washing course and wash parameters;

determining a base wash time based on the received setting data;

determining an input voltage when a heating operation is necessary;

determining a heating time based on the determined input voltage; and outputting the calculated wash time by adding the determined base wash time and the determined heating time; and performing a washing process based on outputted calculated washing time.

11. The operating method of claim 10, wherein determining the input voltage comprises:

obtaining a number of input voltage values by determining the input voltage more than once; and averaging the input voltage values.

12. The operating method of claim 10, wherein the determining the heating time comprises increasing or reducing heating time according to the input voltage in average.

13. The operating method of claim 10, further comprising determining a maximum heating time according to at least one of a wash temperature, an amount of laundry, a wash water level, and a capacity of a heater.

14. The operating method of claim 13, further comprising:

multiplying a heating time coefficient by the input voltage; and determining the heat time by subtracting a result of the multiplication from the maximum heating time.

15. The operating method of claim 14, wherein the heating time coefficient is a ratio of a variation in the heating time to a variation in the input voltage.

16. The operating method of claim 15, further comprising:

obtaining a number of heating time coefficients by varying at least one of the wash temperature, the amount of laundry, the wash water level, and the heater capacity; and storing the heating time coefficients in the washing machine.

17. The operating method of claim 16, wherein determining the heating time further comprises:

selecting one of the heating time coefficients stored in the washing machine; and determining the heating time using the selected heating time coefficient.

18. The operating method of claim 10, further comprising:

when a heating operation ends, calculating an error between the heating time and an actual heating time which is the time actually taken to perform the heating operation; and increasing or reducing the determined wash time by as much as the calculated error.

* * * * *